United States Patent [19]

Crowley

[11] Patent Number: 4,510,977

[45] Date of Patent: Apr. 16, 1985

[54] APPARATUS FOR APPLYING A FORCE

[75] Inventor: John E. Crowley, Boulder, Colo.

[73] Assignee: Houdaille Industries, Inc., Ft. Lauderdale, Fla.

[21] Appl. No.: 515,593

[22] Filed: Jul. 21, 1983

[51] Int. Cl.[3] ..... B21F 9/00

[52] U.S. Cl. ..... 140/123; 269/285; 269/266; 226/151; 254/251; 188/65.1; 24/68 A; 24/134 R

[58] Field of Search ..... 140/123, 123.5; 72/422; 81/9.3, 418, 186, 421, 425 A, 425 R, 426; 269/285, 266, 238; 226/127, 167, 151; 242/107.2; 254/251; 74/577 S; 188/82.7, 67, 65.1; 24/68 R, 68 A, 68 D, 69 ST, 69 TM, 135 A, 134 R

[56] References Cited

U.S. PATENT DOCUMENTS

| | | | |
|---|---|---|---|
| 2,061,217 | 11/1936 | Watcher | 24/68 A |
| 2,322,651 | 6/1943 | MacChesney | 24/134 R |
| 3,103,353 | 9/1963 | Lassy | 269/238 |
| 3,828,893 | 8/1974 | Clark | 188/67 |
| 4,191,503 | 3/1980 | Neff et al. | 188/67 |

*Primary Examiner*—Francis S. Husar
*Assistant Examiner*—Linda McLaughlin
*Attorney, Agent, or Firm*—Sheridan, Ross, & McIntosh

[57] ABSTRACT

A tool for applying banding clamps is provided with means for applying a substantially even amount of force across the transverse direction of a strap to hold the strap in a desired position wherein the force applying means comprises a plurality of superposed levers having means for holding the superposed levers in assembled relationship but permitting relative movement between the levers.

3 Claims, 3 Drawing Figures

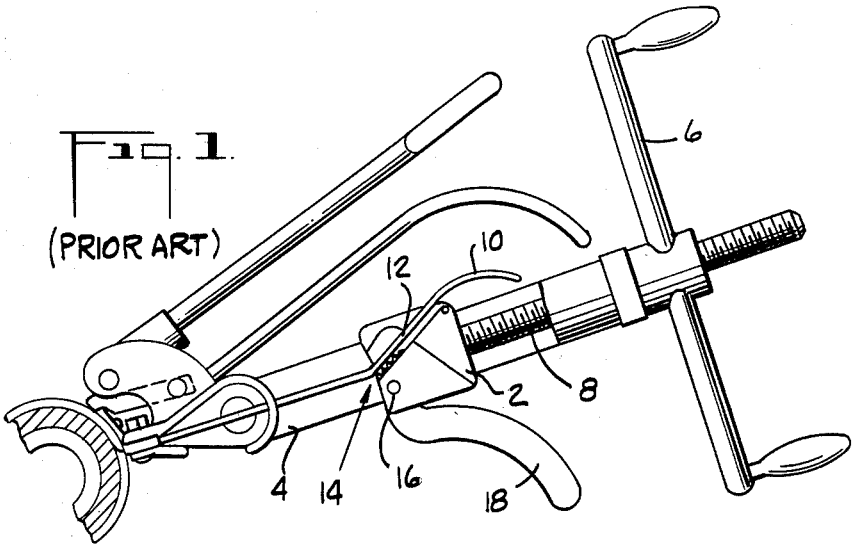
Fig. 1.
(PRIOR ART)
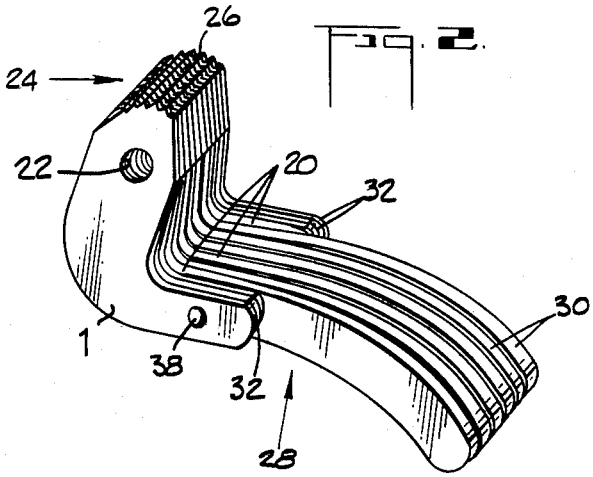
Fig. 2.
Fig. 3
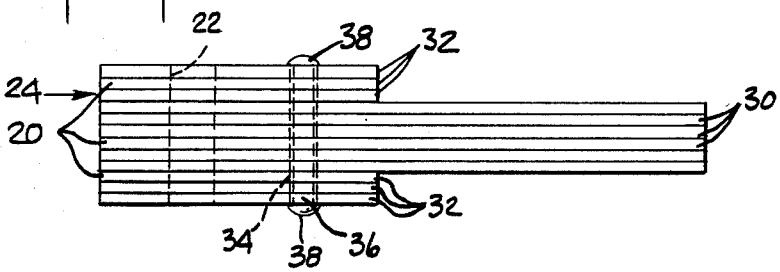

APPARATUS FOR APPLYING A FORCE

FIELD OF THE INVENTION

This invention relates to apparatus for holding an object in place such as in a tool for applying banding clamps having means for pulling the free end of the banding strap so that the desired clamping pressure may be obtained. More specifically this invention relates to clamping means associated with the slide that applies the pulling force.

BACKGROUND OF THE INVENTION

Tools, such as those disclosed in U.S. Pat. Nos. 2,746,324 and 3,067,640, have been used extensively for many years in the application of banding clamps. One important element of the tool used for this service is the clamping means that holds the free end of the strap as the pulling force is applied so that the desired clamping pressure may be obtained. Since in normal use, the clamping means is repeatedly utilized it is subject to wear. In most instances, the wear occurs in the surface used to apply the clamping force. This is the surface on the cam lever that contacts the strap. Unfortunately, this wear does not occur evenly across the surface of the cam lever so that after many uses the cam surface does not contact the strap completely across its transverse direction. Under these conditions, the pulling force is not distributed evenly on the strap and could result in an undesired clamping pressure.

BRIEF DESCRIPTION OF THE INVENTION

This invention is directed to apparatus for applying an equal force to an object having a longitudinal and transverse direction so that the force is applied substantially equally across the transverse direction even though there has been substantial wear in the appratus. In the preferred embodiment, the invention relates to a tool for use in the application of band clamps and relates to the clamping means that holds the strap so that a pulling force may be applied to the free end of the strap to obtain the desired clamping pressure in the band clamp. In a normal tool of this nature, a slide is mounted for movement along a guideway with the slide having a slot through which the free end of the strap is inserted. A pivotally mounted lever of unitary construction is positioned so that a serrated camming surface may be moved against the strap by applying a force to the arm of the lever extending from the pivotal mounting. A pulling force is applied so that the portion of the strap before the clamping means is placed under tension. At this time, the force on the arm of the lever may be released.

In accordance with this invention, the lever is formed by a plurality of superposed levers capable of movement relative to each other. Each of the levers has an opening and a pin extends through the openings in the the superposed levers. The pin is preferably a rivet with an enlarged head at each end thereof so as to be retained in the position extending through the openings. The cross-sectional area of the pin is less than the cross-sectional area of the openings so that the levers may move relative to each other.

This invention improves production in that considerably less accuracy in the manufacturing of the lever and the body of the slide block is required since the laminations of the lever overcome any variances or irregularities. Also, since the laminations of the gripper lever can move in relation to each other, they have a tendency to shed any contaminants which might be present in the area of the gripper teeth. This feature is especially significant when zinc plated carbon steel band is used.

It is an object of this invention to provide apparatus for applying a force that has means to compensate for wear.

It is another object of this invention to provide clamping means for a tool used in applying banding clamps so as to extend the normal life of the tool.

The foregoing and other objects, features, and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

BRIEF DESCRIPTION OF THE DRAWINGS

FIG. 1 is an illustration of a prior art tool used in applying band clamps;

FIG. 2 is a pictorial representation of the superposed levers of this invention; and FIG. 3 is a side elevation of the superposed levers of this invention.

DETAILED DESCRIPTION OF THE INVENTION

In FIG. 1, there is illustrated a prior art tool for applying banding clamps. The tension applying means comprises a slide or fixed base 2 mounted for movement over the frame 4 in response to rotation of the handle 6 moving the bolt 8. The banding strap 10 passes through a slot 12 in the slide 2 and is clamped in position by a cam illustrated generally at 14 which cam is pivotally mounted on pin 16 and has a serrated surface adapted to be moved against the banding strap 10 in response to movement of the lever arm 18. In normal operation, the lead end of the banding strap 10 is positioned in the slot 12 and is clamped in position by rotation of the lever arm 18 which applies a force on the strap across its transverse direction. The handle 6 is rotated to move the slide 2 to apply tension to the portion of the banding strap 10 located before the slide 2. As soon as there exists tension in the banding strap 10, the lever arm 18 may be released since the tension will hold the clamping means against the strap.

This invention provides a new clamping means for use where desired but particularly adapted for use in a tool for applying banding clamps. As illustrated in FIGS. 2 and 3, a plurality of levers 20 are placed in superposed relation. Each of the levers 20 has an opening 22 for mounting the levers 20 for pivotal movement such as around the pivot pins 16 in the prior art device illustrated in FIG. 1. Each of the levers is provided with a camming surface 24 adapted to be moved into position against the banding strap in a manner similar to that in the prior art device illustrated in FIG. 1. In the preferred embodiment, each surface 24 is provided with serrations 26. Each of the levers 20 is provided with an arm 28. In the preferred embodiment of the invention, the arms 30 of the centrally located levers 20 are longer than the arms 32 on the outer sides of the superposed levers 20. However, all of the arms 30 can be of the same length.

As illustrated in FIG. 3, each lever arm 28 is provided with an opening 34. A pin 36 passes through the openings 34 when the levers 20 are in superposed relation. Each end of the pin 36 is provided with an enlargement 38 having a cross-sectional area greater than the cross-sectional area of the opening 34 so as to retain the pin 36 in position. In the preferred embodiment of the invention the pin 36 is a rivet. The cross-sectional area of the pin 36 is less than the cross-sectional area of each of the openings 34 so that the superposed levers 30 may be moved relative to each other.

In operation, the superposed levers 20 are mounted for rotation about a pivot 16 in a slide such as that illustrated in the prior art of FIG. 1. After the strap 10 has been inserted into the slot 12, the lever arms 28 are rotated about the pivot 16 to move the serrations 26 on the camming surface 24 into contact with the strap 10. If the serrations 26 on the various camming surfaces have been worn down unevenly, the loose fit of the pin 36 in the openings 34 allow the individual levers 20 to move relative to the others so that a substantially even force may be applied across the transverse direction of the strap.

In the preferred embodiment of the invention, each lever is made from spring steel but other materials such as carbon steel, stainless steel and bronze can be used. There may be as many superposed levers 20 as desired. In a tool for use with banding straps having a transverse direction of from about $\frac{1}{4}$ inch to $\frac{3}{4}$ inch, twelve levers each having a thickness of 1/16 inch were used. There were six central levers 30 having a longitudinal centerline length of $3\frac{1}{4}$ inches and three outer levers 32 on each side having a longitudinal centerline length of $1\frac{1}{4}$ inches. In the preferred embodiment, the cross-sectional configuration of the pin 36 and the openings 34 is circular but other configurations may be used as long as the cross sectional area of the pin 36 is less than the cross sectional area of the openings 34. In the tool described as preferred, the pin 36 is circular having a diameter of 0.125 inch and the openings 34 are circular having a diameter of 0.135 inch. If desired, a flexible cover, such as a tubular sleeve closed at one end and made from a material such as vinyl, may be placed over the arms 30.

While the preferred embodiments of the invention have been described herein, the invention may be otherwise embodied and practiced within the scope of the following claims.

What is claimed is:

1. Apparatus for applying a substantially equal force to an object comprising:

a fixed base having a slot adapted to support an object having longitudinal and transverse directions;

cam gripping means comprising a plurality of levers;

means pivotally mounting said plurality of levers on said fixed base;

each of said levers having a portion extending from said pivot means in one direction, each of said portions having a gripping surface which in operative position faces said slot of said fixed base;

each of said levers having an arm extending from said pivot means in a direction opposite to said one direction so that an independent force may be selectively applied to each of said arms to pivot each of said levers around said pivot means and to move said gripping surface of each of said portions toward said slot of said fixed base to apply said force to an object which may be supported therein; and said pivot means holding said arms in an assembled relationship but permitting relative movement between said arms to compensate for uneven wear of said gripping surfaces on said portions comprising:

means defining an opening in each of said arms;

a pin extending through each of said openings;

means adjacent each end of said pin for holding said pin in its relationship extending through said openings; and said pin having a cross-sectional area substantially less than the cross-sectional area of each of said openings so that said pin is loosely fitted in each of said openings so that said arms may be moved relative to each other in response to said force.

2. Apparatus as in claim 1 wherein:

the cross-sectional configuration of said pin and each of said openings is circular.

3. Apparatus as in claim 2 wherein:

the inner diameter of each of said openings is at least 0.01 inch greater than the outer diameter of said pin.

* * * * *